United States Patent [19]

Piatt

[11] Patent Number: 5,004,271

[45] Date of Patent: Apr. 2, 1991

[54] GREETING CARD SYSTEM

[76] Inventor: Richard Piatt, 7115 Richmond Hwy., Apt. 83, Alexandria, Va. 22306

[21] Appl. No.: 330,371

[22] Filed: Mar. 29, 1989

[51] Int. Cl.[5] ..... B42D 15/02

[52] U.S. Cl. ..... 283/65; 40/488; 40/490; 206/232; 229/92.8

[58] Field of Search ..... 283/56, 65; 40/124.1, 40/488, 489, 490; 206/232; 229/92.8

[56] References Cited

U.S. PATENT DOCUMENTS

| | | | |
|---|---|---|---|
| 274,799 | 3/1883 | Lyman | 434/172 |
| 1,434,009 | 10/1922 | Harris | 229/92.8 |
| 1,596,088 | 8/1926 | Espey | 229/92.8 X |
| 2,336,867 | 12/1943 | Huber | 40/124.1 X |
| 4,200,222 | 4/1980 | Feuer | 229/92.8 |
| 4,439,941 | 4/1984 | Halperin | 40/124.1 |
| 4,622,768 | 11/1986 | Moreau | 40/124.1 |

FOREIGN PATENT DOCUMENTS

| | | | |
|---|---|---|---|
| 17253 | of 1906 | United Kingdom | 229/92.8 |

*Primary Examiner*—Frank T. Yost
*Assistant Examiner*—Eugenia A. Jones
*Attorney, Agent, or Firm*—Donald A. Kettlestrings

[57] ABSTRACT

A personalized greeting card system includes a foldable sheet member defining first and second panels and a plurality of interchangeable sleeve elements for removably fitting over and around the second panel. Each of the sleeve elements is provided with a separate printed message or greeting. The first panel defines opposed front and rear surfaces, and the front surface has a printed message or greeting thereon which preferably includes a person's name. The rear surface has a plural-lined printed message or greeting thereon which uses the letters of the person's name as the first letter of each line of the plural-lined message.

6 Claims, 2 Drawing Sheets

Fig. 1.
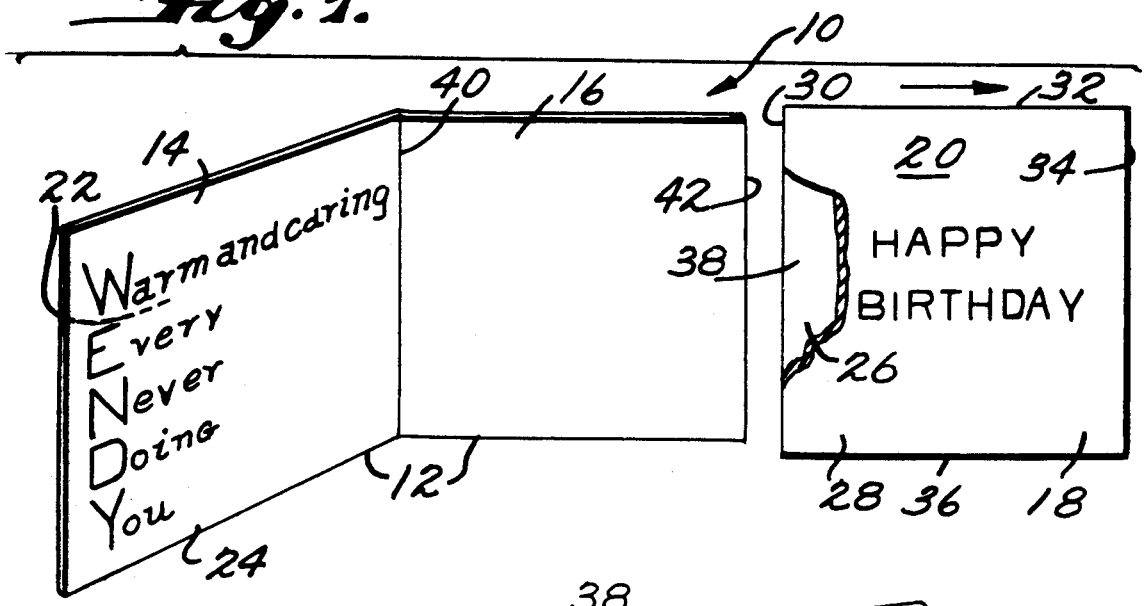
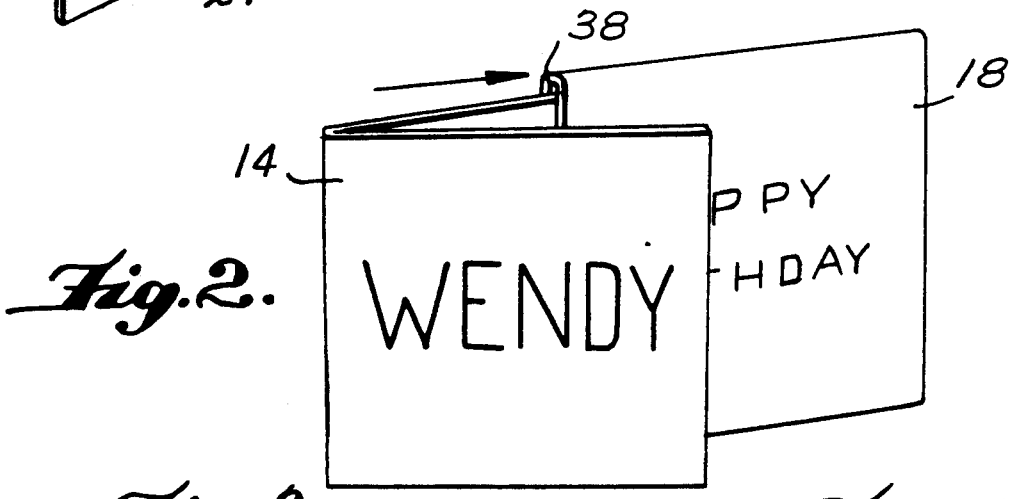
Fig. 2.
Fig. 3.
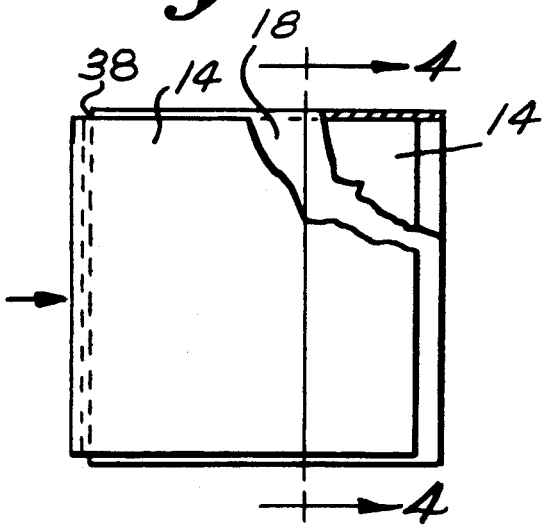
Fig. 4.
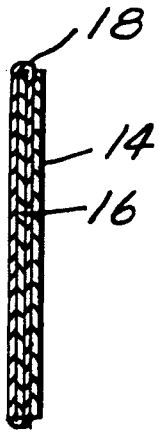

GREETING CARD SYSTEM

This invention relates to a new and improved greeting card and more particularly to a greeting card system which permits the sender to transmit a personalized message or greeting for a specific occasion.

Various types of greeting cards are known, but known cards have not provided the flexibility of providing personalized greetings or messages for various specific occasions.

It is, therefore, an object of the present invention to provide a greeting card system.

Another object is to provide a greeting card system which enables the sender to transmit a personalized message to a specifically named person for various specific occasions.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a greeting card system which includes a foldable sheet member defining first and second panels, and a separate sheet element for removably fitting over and around the second panel. More specifically, the sleeve element is provided with a printed message or greeting, and a plurality of interchangeable sleeve elements are provided, each of the sleeve elements having a separate printed message or greeting thereon. In accordance with the invention, the first panel preferably includes a front surface having a printed message or greeting thereon which includes a person's name, and a rear surface of the first panel has a plural-lined printed message or greeting thereon which uses the letters of the person's name as the first letters of each line of the plural-lined message or greeting.

It is to be understood that both the foregoing general description and the following detailed description are exemplary and explanatory but are not restrictive of the invention.

The accompanying drawings, which are incorporated in and constitute a part of this specification, illustrate examples of preferred embodiments of the invention and, together with the description, serve to explain the principles of the invention.

FIG. 1 is a perspective view, partly broken away, of the greeting card system, before the second panel has been inserted into a sleeve;

FIG. 2 is an end elevation view of the system with the second panel positioned within a sleeve;

FIG. 3 is a front perspective view of the system and showing the second panel positioned within a sleeve;

FIG. 4 is a cross-sectional view of the greeting card system taken along the line 4—4 in FIG. 3 and looking in the direction of the arrows.

Figure 5:
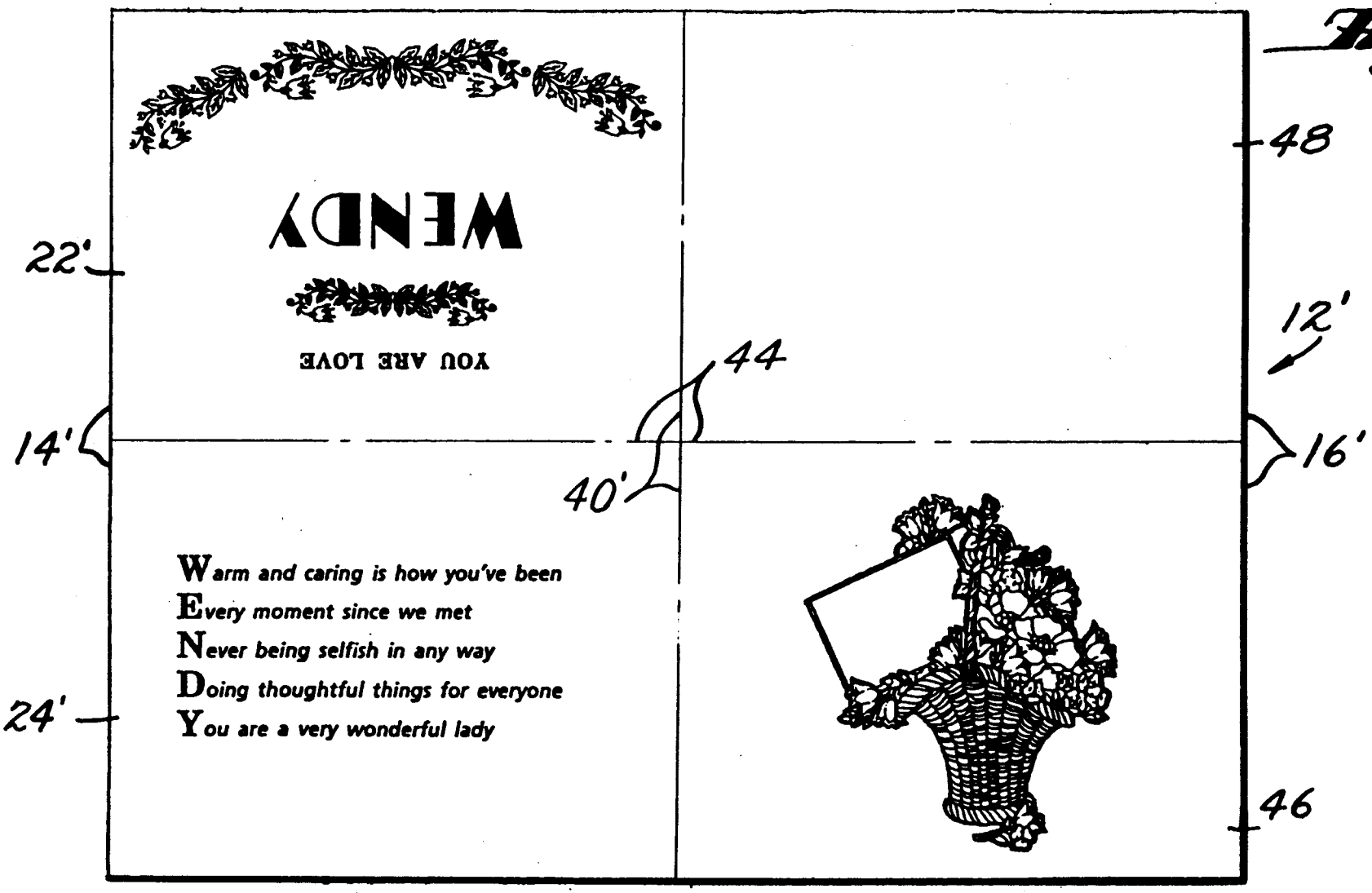
FIG. 5 is a front view of the foldable sheet member in an alternative embodiment of the invention.

With reference now to the drawings, wherein like reference characters designate like or corresponding parts throughout the several views, there is shown a greeting card system 10 which comprises a foldable sheet member 12 defining first and second panels 14, 16. A separate sheet element 18 is provided for removably fitting over and around panel 16, and sleeve element 18 is provided with a first printed message or greeting on a first side 20 thereof.

In accordance with the invention, a plurality of separate and interchangeable sleeve elements 18 are provided, and each of the sleeve elements is provided with a separate printed message or greeting on first side 20 thereof.

First panel 14 defines opposed front and rear surfaces 22, 24, and front surface 22 is provided with a second printed message or greeting thereon which preferably includes a person's name. Rear surface 24 is provided with a plural-lined third printed message or greeting thereon which uses the letters of the person's name as the first letters of each line of the plural-lined message or greeting.

Each of sleeve elements 18 is comprised of first and second sheet elements 26, 28 which are substantially identical in size and shape to each other, and each sheet element 26, 28 defines a plurality of edges 30, 32, 34 and 36. Sheet elements 26, 28 are connected to each other by glue or other conventional means substantially along edges 32, 34 and 36 to form a slit-like opening 38 in sleeve element 18 along edges 30 of sheet elements 26, 28.

More specifically, sheet member 12 is preferably folded along fold 40, and second panel 16 defines an edge 42 which is substantially opposite from fold 40. The length of edge 42 is less than the length of opening 38 so that edge 42 can be received within opening 38 and between sheet elements 26, 28, and each of sleeve elements 18 can, thus, be separately slideably positioned over second panel 16 to provide a separate and interchangeable message or greeting on side 20.

Panels 14, 16 can be of various shapes and sizes, and sheet elements 26, 28 are substantially identical in shape to each other and to second panel 16. Sheet elements 26, 28, however, are slightly larger in size than second panel 16 so that sleeve elements 18 each substantially completely encloses second panel 16 when each sleeve element is removably slipped over and onto second panel 16.

The greeting card system described herein provides a unique way for communicating a very personalized message to a specifically named person for a variety of specific occasions. A number of different sheet members 12 are provided which are separately addressed to specific names. For example, the printed message or greeting on front surface 22 may incorporate the name "Wendy" so that the card is personalized. A plural-lined message or greeting on rear surface 24 uses the letters in the name "Wendy" as the first letters of each line of the plural-lined message or greeting. For example, the plural-lined message on rear surface 24 could read as follows:

Warm and caring is how you've been
Every moment since we met
Never being selfish in any way
Doing thoughtful things for everyone
You are a very wonderful lady.

A large number of sleeve elements 18 can be stocked and sold separately by the retailer. A variety of printed messages or greetings can be provided on sleeve elements 18. For example, a separate message on each sleeve element 18 could say "Happy Birthday", "Happy Mother's Day", "Congratulations to the Graduate" or any other desired message for a specific occasion. The consumer can then select and purchase a sheet member 12 which is personalized and addressed by name to the intended recipient, and the consumer can also separately purchase a sleeve element 18 which provides an additional message for a specific occasion. The consumer can quickly and easily slide sleeve element 18 over second panel 16 so that a very personalized card for a specific occasion results.

An alternative embodiment of the invention is illustrated in FIG. 5. In this embodiment, rectangular foldable sheet member 12' is first folded substantially in half along fold 44. Sheet 12' is again folded along fold 40' to form first and second panels 14', 16'. First panel 14' defines opposed front and rear surfaces 22', 24', and second panel 16' defines opposed front and rear surfaces 46, 48.

Panels 14', 16' can be of various shapes and sizes, and sheet elements 26, 28 of each of sleeve elements 18 are substantially identical in shape to second panel 16' Sheet elements 26, 28, however, are slightly larger in size than panel 16' so that sleeve elements 18 each substantially completely encloses panel 16' when each sleeve element is removably slipped over and onto panel 16'.

In this alternative embodiment, the printed message or greeting on front surface 22' incorporates a specific person's name so that the card is personalized. A plural-lined message or greeting on rear surface 24' uses the letters in the name as the first letters of each line of the plural-lined message or greeting. Sleeve elements 18 can be quickly and easily slipped over panel 16' so that a personalized card for a specific occasion results.

The invention in its broader aspects is not limited to the specific details shown and described, and departures may be made from such details without departing from the principles of the invention and without sacrificing its chief advantages.

What is claimed is:

1. A greeting card system comprising:

a foldable sheet member defining first and second panels;

a separate sleeve element for removably fitting over and around said second panel, said sleeve element comprised of first and second sheet elements, each of said sheet elements defining a plurality of edges and a separate free, exposed edge, said sheet elements connected to each other substantially along said plurality of edges with said exposed edges positioned in opposed relationship with each other of form a slit-like opening in said sleeve element contiguous with and between said exposed edges, and said sleeve element having a first printed message thereon; and wherein said first panel defines opposed front and rear surfaces, said front surface having a second printed message thereon and said rear surface having a plural-lined third message thereon which uses letters of a predetermined portion of said second message as first letters of each line of said third message.

2. A greeting card system as in claim 1 wherein said sheet elements are substantially identical in size and shape to each other.

3. A greeting card system as in claim 1 wherein said sheet member is folded and wherein said second panel defines an edge substantially opposite from said fold in said sheet member.

4. A greeting card system as in claim 3 wherein the length of said opposite edge is less than the length of said opening whereby said opposite edge can be received within said opening and between said sheet elements and said sleeve element can be slideably positioned over said second panel.

5. A greeting card system as in claim 4 wherein said sleeve element is substantially identical in shape to said second panel but larger in size than said second panel whereby said sleeve element substantially completely encloses said second panel when said sleeve element is removably slipped over and onto said second panel.

6. A greeting card system as in claim 5 further including a plurality of said sleeve elements interchangeable with each other, each of said sleeve elements having a separate printed message thereon different from said first message.

* * * * *